US006173135B1

(12) United States Patent
Yuminamochi et al.

(10) Patent No.: US 6,173,135 B1
(45) Date of Patent: Jan. 9, 2001

(54) IMAGE FORMING APPARATUS WITH A BIAS CONTROL FEATURE

(75) Inventors: Takayasu Yuminamochi, Shizouka-ken; Masaru Shimura, Numazu, both of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/349,484

(22) Filed: Jul. 9, 1999

(30) Foreign Application Priority Data

Jul. 13, 1998 (JP) ..... 10-197859

(51) Int. Cl.[7] ..... G03G 15/00; G03G 15/16
(52) U.S. Cl. ..... 399/66; 399/101; 399/313
(58) Field of Search ..... 399/66, 101, 297, 399/313, 314

(56) References Cited

U.S. PATENT DOCUMENTS 5,132,738 * 7/1992 Nakamura et al. ..... 399/101
5,337,127 * 8/1994 Imaue ..... 399/101
5,621,509 * 4/1997 Karashima et al. ..... 399/66 X
5,689,771 * 11/1997 Sato et al. ..... 399/101
5,692,232 * 11/1997 Okano et al. ..... 399/313 X
5,717,981 * 2/1998 Yamanaka ..... 399/101
5,822,649 * 10/1998 Karashima et al. ..... 399/66
5,832,335 * 11/1998 Fukasaw ..... 399/66
5,857,132 * 1/1999 Mizuishi et al. ..... 399/66
5,873,019 * 2/1999 Mizuishi ..... 399/313
5,970,297 * 10/1999 Gross ..... 399/313

* cited by examiner

*Primary Examiner*—William J. Royer
(74) *Attorney, Agent, or Firm*—Fitzpatrick, Cella, Harper & Scinto

(57) ABSTRACT

An image forming apparatus includes an image bearing body for bearing a toner image, a transfer member for electrostatically transferring the toner image from the image bearing body, a cleaning bias applying device for electrically cleaning the transfer member by applying a cleaning bias to the transfer member, wherein the cleaning bias applying device applies the cleaning bias to the transfer member after a one image forming job is finished, and a controller for controlling the application of the cleaning bias in accordance with the number of sheets to be image-formed in one image forming job.

10 Claims, 10 Drawing Sheets

IMAGE FORMING APPARATUS WITH A BIAS CONTROL FEATURE

BACKGROUND OF THE INVENTION

1. Field of the Invention

The present invention relates to an image forming apparatus of electrophotographic or electrostatic type such as a copying machine, a printer and the like, and more particularly, it relates to an image forming apparatus having a transfer portion urged against an image bearing member.

2. Related Background Art

FIG. 12 shows an example of an electrophotographic image forming apparatus.

In this example, the image forming apparatus utilizes a transfer roller 11 urged against a photosensitive drum 1 as a transfer member for transferring a toner image formed on the photosensitive drum 1 onto a transfer material P.

If toner is adhered to a surface of the transfer roller 11, smears on a back surface of the sheet will be generated, it is preferable that, when the sheet is not passed through the transfer roller, a cleaning bias having a polarity opposite to that of the toner adhered to the transfer roller is applied to transfer the toner onto the photosensitive drum 1, and the transferred toner is collected by a cleaning device 5.

FIG. 10 is a sequence chart showing a relationship between surface potential of the photosensitive drum 1 (photosensitive drum potential) in the above-mentioned image forming apparatus, developing bias, transfer bias and cleaning bias. In this case, a relationship between the surface potential of the photosensitive drum 1, the developing bias of a developing device 3 and the transfer bias of a transfer device 4 is shown by using a circumferential position of the photosensitive drum 1 as a reference.

The photosensitive drum 1 is uniformly charged with dark potential $V_D$ of −650V by a charge roller 6, and the uniformly charged portion is exposed in accordance with image information to form an electrostatic latent image.

On the photosensitive drum 1, the dark potential $V_D$ of the surface is maintained to −650V by the charge roller 6 from when pre-rotation in which the charged position reaches a transfer nip portion N is effected in synchronous with a timing for reaching the transfer material P to the transfer nip portion N to when the charged position reaches the transfer nip portion N in synchronous with a timing for passing a trailing end of a final transfer sheet P through the transfer nip portion N. In this case, bright potential $V_L$ of an image portion of the electrostatic latent image formed by exposure light L becomes −200V.

A DC voltage developing bias of −500V is applied from a developing bias applying power source 10 to a developing roller 9 from when pre-rotation in which the electrostatic latent image on the photosensitive drum 1 is developed and is reached to the transfer nip portion N is effected in synchronous with a timing for reaching the transfer material P to the transfer nip portion N to when a toner image reaches the transfer nip portion N in synchronous with a timing for passing the final transfer sheet P through the transfer nip portion N.

The cleaning bias of −1500V is applied from a transfer roller cleaning bias applying power source 23 to the transfer roller 11 when the surface potential of the photosensitive drum 1 is zero in the pre-rotation and post-rotation. When the sheet is passed, transfer bias $V_T$ is applied to the transfer roller, and, between the sheets (i.e., in a sheet interval), bias voltage $V_{TO}$ smaller than the transfer bias is applied to the transfer roller. In this case, the transfer bias $V_T$ is a voltage for reserving transfer current required during the passing of the sheet and is varied in accordance with the resistance of the transfer roller 11. In order to cope with a transfer material P having A3 size or Letter-size, a voltage capable of reserving current of about 10 $\mu$A is applied to the transfer roller. In the sheet interval, although a voltage for reserving the same transfer current as that in the passing of the sheet is applied, since there is no sheet, the bias voltage $V_{TO}$ is made smaller in order to prevent transfer memory to the photosensitive drum 1.

As methods for cleaning the toner on the transfer roller 11, as well as a method for applying constant voltage as the cleaning bias as shown in FIG. 10, there is a method for applying a negative voltage and positive voltage alternately as shown in FIG. 11. An example of the latter is shown in FIG. 11.

The toner adhered to the transfer roller 11 as the smears includes not only the properly charged toner but also toner charged oppositely within the developing device 3 and/or toner which was properly charged and which was then charged with opposite polarity by discharge action generated during the application of the cleaning bias.

If negative toner and positive toner are adhered to the transfer roller 11 in this way, as shown in FIG. 11, in pre-rotation and post-rotation, negative bias and positive bias might be applied to the transfer roller 11 as the cleaning bias.

When the cleaning bias is applied to the transfer roller 11, memory may be generated on the photosensitive drum 1 due to the cleaning bias to affect a bad influence upon next image formation.

The influence of the memory can be prevented by removing AC electricity from the photosensitive drum 1 (charged by the cleaning bias) by means of a charger 2.

However, since a voltage applied as AC bias for primary charging has a high peak-to-peak voltage such as 1500 to 2000 $V_{PP}$, a discharge phenomenon occurs in the vicinity of a charging nip portion between the charge roller 6 and the photosensitive drum at upstream and downstream sides thereof.

When a photosensitive layer on the surface of the photosensitive drum 1 is formed from OPC (organic photosensitive body), for example, due to a discharge phenomenon at the surface of the layer, molecular chains are broken, thereby tending the OPC layer to be fragile, with the result that the OPC layer will be apt to be worn by the sliding contact with the cleaning blade 13.

For these reasons, when an AC bias is applied from the charger 2 in order to effect the cleaning of the transfer roller, a service life of the OPC photosensitive layer and therefore a service life of the photosensitive drum 1 will be shortened.

SUMMARY OF THE INVENTION

An object of the present invention is to provide an image forming apparatus which can prevent smears on a transfer roller.

Another object of the present invention is to provide an image forming apparatus which can prevent potential memory on a photosensitive member.

A further object of the present invention is to provide an image forming apparatus in which a service life of the photosensitive member is not shortened.

A still further object of the present invention is to provide an image forming apparatus comprising an image bearing member for bearing a toner image, a transfer member for electrostatically transferring the toner image on the image bearing member, a cleaning bias applying means for electrostatically cleaning the transfer member by applying cleaning bias to the transfer member, and a control means for controlling application of the cleaning bias in accordance with the number of sheets to be image-form ed in one image forming job.

The other objects and features of the present invention will be apparent from the following detailed explanation of the invention.

DESCRIPTION OF THE PREFERRED EMBODIMENTS

The present invention will now be explained in connection with embodiments thereof with reference to the accompanying drawings.

Figure 1:
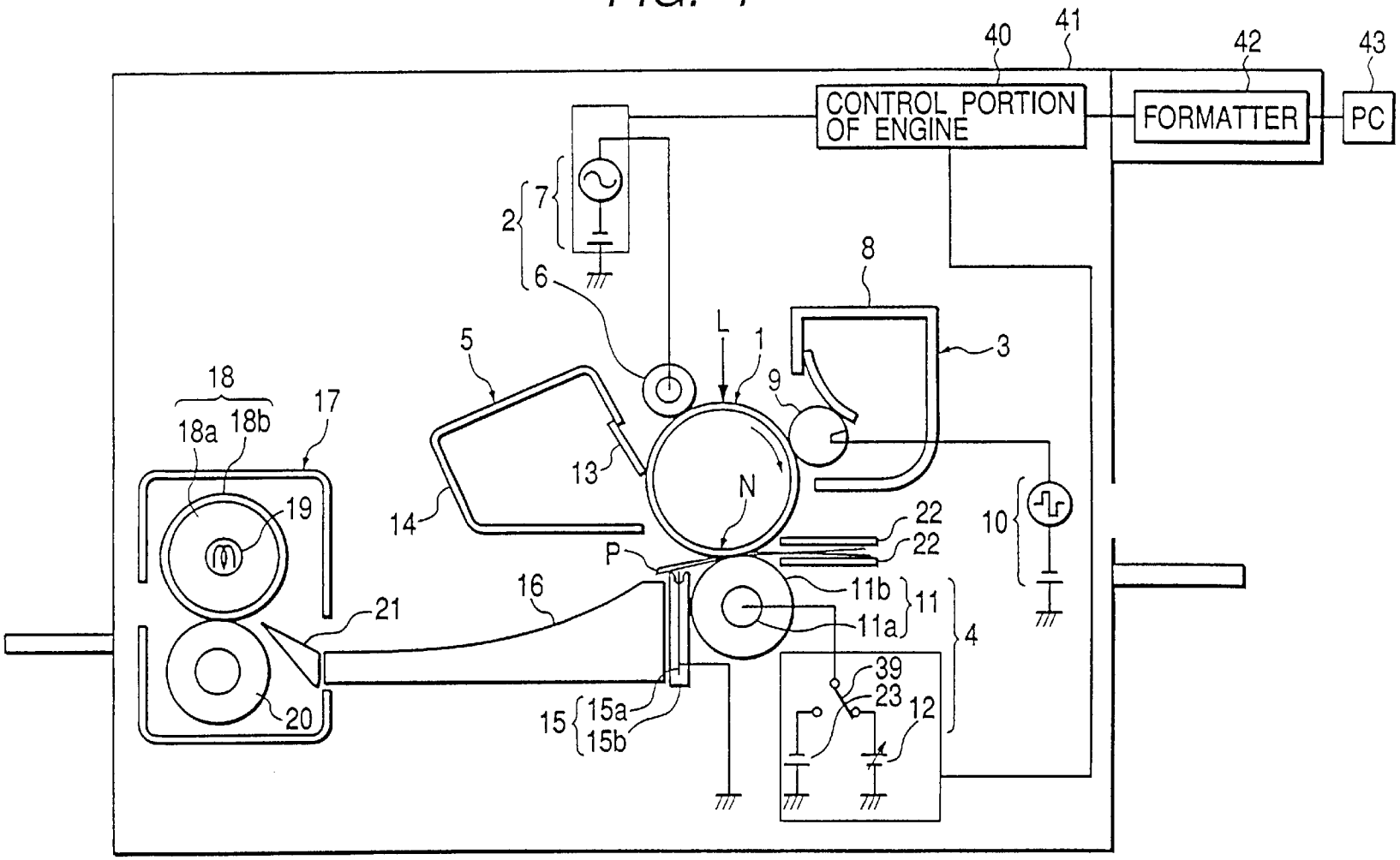
FIG. 1 is a view showing a schematic construction of an image forming apparatus according to a first embodiment of the present invention.

FIG. 1 is a sectional view of an image forming apparatus according to a first embodiment of the present invention.

The image forming apparatus shown in FIG. 1 includes a photosensitive member as an image bearing member. The photosensitive member is a rotary drum-shaped electrophotographic photosensitive member (referred to as "photosensitive drum" hereinafter) 1 constituted by coating an organic photosensitive body (OPC) photosensitive layer on a surface of an aluminum cylinder. The photosensitive drum 1 has an outer diameter of 30 mm and is rotated at a process speed (peripheral speed) of 150 mm/sec.

Around the photosensitive drum 1, along a rotational direction thereof (shown by the arrow), there are disposed, in order, a charging device 2 for uniformly charging the photosensitive drum 1, an exposure device (not shown) for emitting exposure light (laser light) L to form an electrostatic latent image on the photosensitive drum 1, a developing device 3 for forming (visualizing) a toner image by adhering toner to the electrostatic latent image formed on the photosensitive drum 1, a transfer device 4 for transferring the toner image formed on the photosensitive drum 1 onto a transfer sheet P such as a paper sheet, and a cleaning device 5 for cleaning the surface of the photosensitive drum 1.

Among them, the charging device 2 includes a charge roller 6 as a contact charging member, and a charging bias applying power source 7 for applying charging bias to the charge roller 6.

The developing device 3 includes a developing container 8 for storing toner as developer, a developing roller (developing member) 9 for visualizing the electrostatic latent image formed on the photosensitive drum 1 by transferring the toner to the drum, and a developing bias applying power source 10 for applying developing bias to the developing roller 9.

The transfer device 4 includes a transfer roller (contact transfer member) having an outer diameter of 20 mm, a transfer bias applying power source 12 for applying transfer bias of about 1000 to 6000 V to the transfer roller 11, a transfer roller cleaning bias applying a power source 23 for applying transfer roller cleaning bias to the transfer roller 11 in non-passing of sheet, and a switch 39 for selecting either the transfer bias applying power source 12 or the transfer roller cleaning bias applying power source 23 to apply the bias to the transfer roller 11. The transfer roller 11 is constituted by coating a conductive elastic layer 11*b* on a metallic core cylinder 11*a*, and the elastic layer 11*b* has a resistance value of about $10^6$ to $10^{10}$ Ω·cm.

The cleaning device 5 includes a cleaning blade 13 for scraping toner (transfer residual toner) remaining on the surface of the photosensitive drum which was not transferred to the transfer material, and a collecting container 14 for storing the transfer residual toner scraped by the cleaning blade 13 as waste toner.

The transfer sheet P to which the toner image was transferred is separated from the photosensitive drum 1 due to the small diameter of the photosensitive drum, and electricity on the transfer sheet is removed by an electricity removing probe unit (separation aiding means) 15. As a result, an electrostatic adsorbing force between the transfer sheet P and the photosensitive drum 1 is weakened, thereby separating the transfer sheet from the photosensitive drum 1.

The electricity removing probe unit 15 includes an electricity removing probe 15*a* and an insulation member 15*b*, and the electricity removing probe 15*a* is electrically grounded.

After the separation, the transfer sheet P is guided on a convey guide 16 made of insulation resin to be conveyed to a fixing device 17.

The fixing device 17 includes a fixing roller 18 (having a PFA mold releasing layer 18*b* obtained by spray-coating or dispersion-coating PFA particles on a cylindrical aluminum core 18*a* and then by baking PFA), a halogen heater 19 for heating the fixing roller internally, a pressure roller 20 for urging the transfer sheet P against the fixing roller 18, and a fixing inlet guide 21 for directing the transfer sheet P into a fixing nip portion between the fixing roller 18 and the pressure roller 20. While the transfer sheet P bearing a non-fixed toner image is being passed through the fixing nip portion, the toner image is melted and fixed to the surface of the transfer sheet P.

The photosensitive drum 1 is uniformly charged with negative dark potential VD of about −650V by applying the charging bias from the charging bias applying power source 7 to the charge roller 6 and then is image-exposed by the exposure light L, thereby forming the electrostatic latent image in which the exposed portion has bright potential $V_L$. In this case, the potential $V_L$ is about −200V.

The electrostatic latent image formed on the photosensitive drum 1 is developed by the developing device 3. That is to say, the electrostatic latent image formed on the photosensitive drum 1 is developed (visualized) as the toner image by transferring the negatively charged toner on the developing roller 9 onto the bright potential $V_L$ portion on the photosensitive drum 1 by applying the developing bias from the developing bias applying power source 10 to the developing roller 9.

The toner image formed on the photosensitive drum 1 is transferred onto the transfer sheet P conveyed along transfer guides 22, in a transfer nip portion N between the photosensitive drum 1 and the transfer roller 11.

Further, the toner adhered to the transfer roller 11 as smears during the transferring is transferred onto the photosensitive drum 1 by applying a bias having the same polarity as the charging polarity of the toner from the transfer roller cleaning bias applying power source 23 to the transfer roller 11 in pre-rotation and post-rotation (non-passing of sheet), and the transferred toner is collected by the cleaning device 5, thereby cleaning the surface of the photosensitive drum 1.

The above-mentioned image forming apparatus according to the first embodiment of the present invention shown in FIG. 1 further includes a printer engine 41 having an engine control portion 40 and a formatter 42, which formatter 42 is connected to an external device 43 such as a personal computer PC.

In the image formation (print), an image signal and a sheet number signal from the external device 43 are transmitted to the formatter 42 of the image forming apparatus (referred to as "printer" hereinafter), where the image signal is converted into an ON/OFF signal for the exposure device.

The engine control portion 40 receives a signal from the formatter 42 and effects engine control for the print while communicating with the formatter 42.

Figure 2:
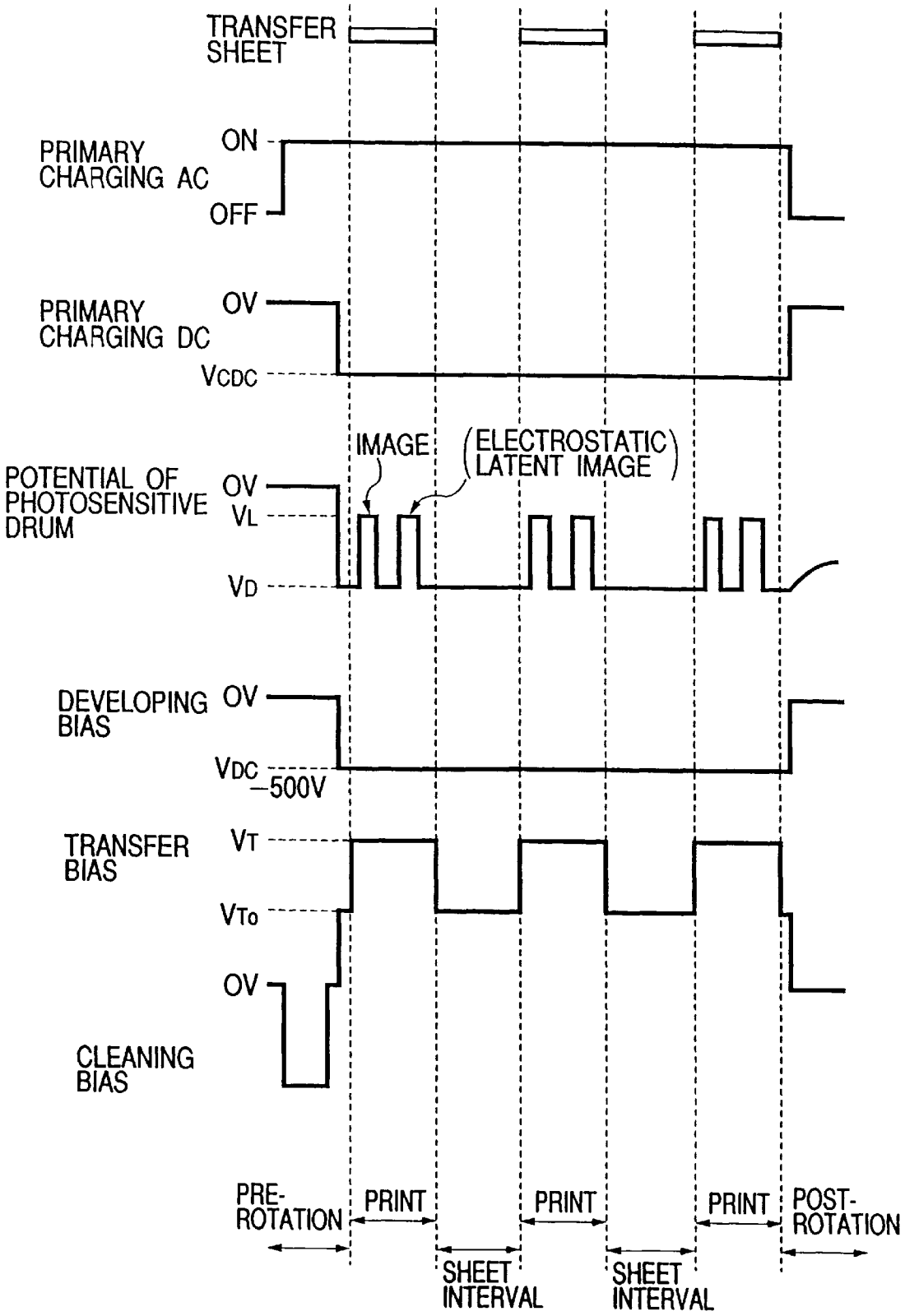
FIG. 2 is a sequence chart for cleaning a transfer roller when the number of prints is small.
Figure 3:
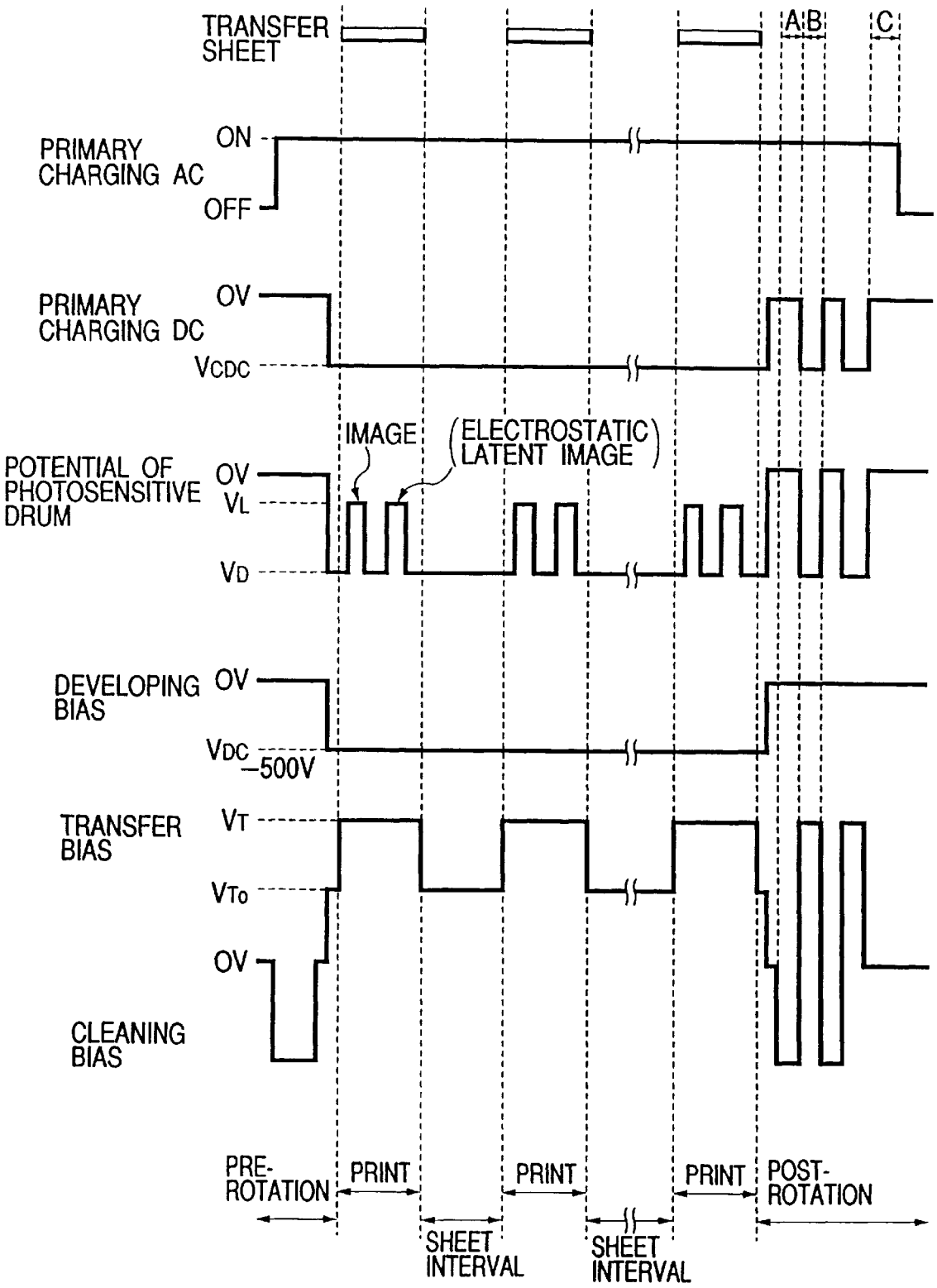
FIG. 3 is a sequence chart for cleaning a transfer roller when the number of prints is great.

In the illustrated embodiment, the application of the charging bias and the application of the transfer roller cleaning bias are effected as shown in FIGS. 2 and 3.

FIG. 2 shows a sequence chart when the number of sheets is small (for example, 1 to 19 sheets).

Figure 10:
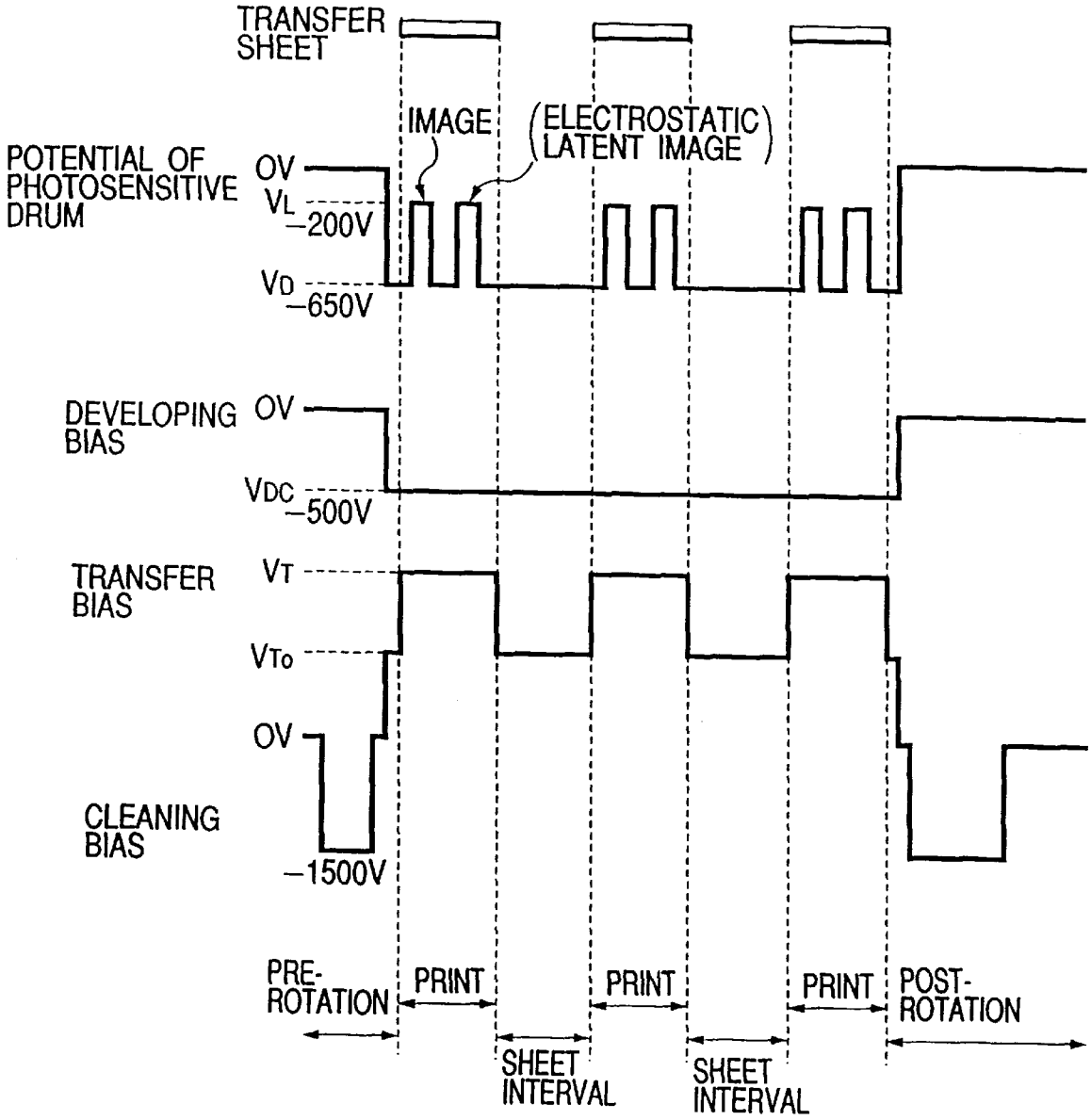
FIG. 10 is a sequence chart for cleaning a transfer roller.
Figure 11:
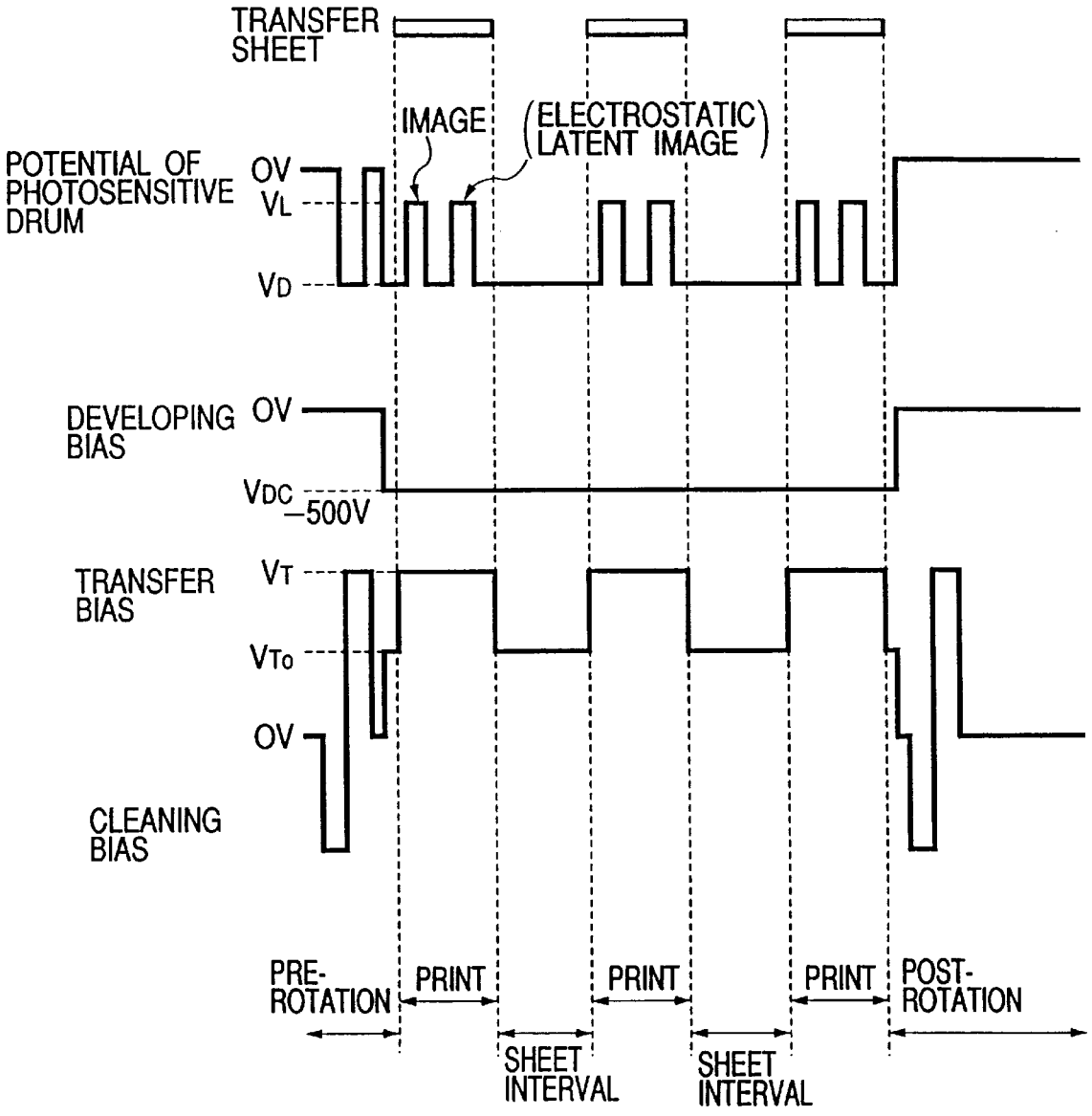
FIG. 11 is another sequence chart for cleaning a transfer roller.
Figure 12:
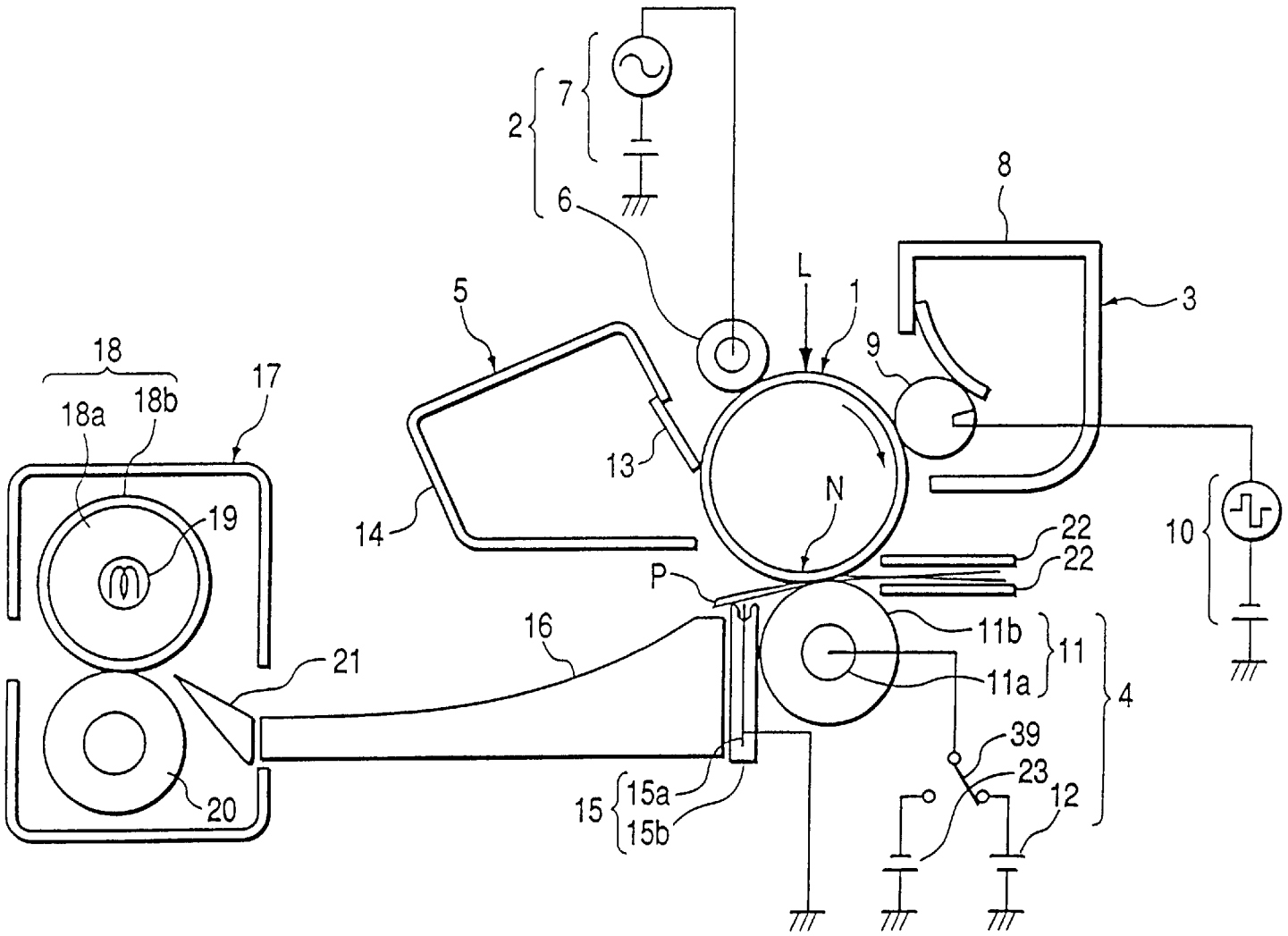
FIG. 12 is a view showing a schematic construction of an image forming apparatus.

Here, an example of continuous print for three sheets is shown. Since a zone between the pre-rotation and the post-rotation is the same as that in the example shown in FIG. 10, duplicated explanation will be omitted.

In the post-rotation, immediately after the print is finished, the primary charging AC bias is turned OFF. As a result, a time period for applying the primary charging AC bias is shortened to reduce degradation of the OPC layer due to discharge, thereby improving the service life of the photosensitive drum 1.

Here, "pre-rotation" means a step for effecting pre-process of the photosensitive member from when the print command is inputted to when the print is started, and "post-rotation" means a step for effecting post-process of the photosensitive member after the print is finished.

On the other hand, FIG. 3 shows a sequence chart when the number of sheets is great (continuous print for twenty or more sheets). When twenty or more sheets are printed, the cleaning of the transfer roller is effected in the post-rotation. In the sequence of the post-rotation, first of all, the primary charging DC bias is changed to 0 Volt at a circumferential position on the photosensitive drum 1 in synchronous with the changing of the transfer bias to the cleaning bias. When this is assumed as a zone A, it is preferable that the zone A is greater than one circumference of the transfer roller 11 and is equal to integral times of the time period required for one revolution of the transfer roller 11.

Then, the bias of the transfer roller is set to the transfer bias $V_T$. In synchronous with this position on the circumferential surface of the photosensitive drum 1, the primary charging DC bias of the charge roller 6 is set to $V_D$ converging bias $V_{CDC}$ and the potential of the photosensitive drum is set to $V_D$. The value $V_{CDC}$ is generally set to a value obtained by adding about 10 to 30 V to the $V_D$ potential of the photosensitive drum 1.

The reason that the potential of the photosensitive drum 1 is selected to $V_D$ of −650V when the positive bias is applied to the transfer roller 11 is to prevent so-called transfer memory tending to charge the photosensitive drum 1 by the transfer bias.

In this way, by setting the potential of the photosensitive drum 1 to 0 Volt when the negative potential is applied to the transfer roller 11 and by setting the potential of the photosensitive drum to $V_D$ of −650V when the positive bias is applied to the transfer roller, cleaning contrast can be increased, thereby improving the cleaning ability.

When it is assumed that a zone in which the transfer bias $V_T$ is applied to the transfer roller 11 is "B", similar to the zone A, it is preferable that the zone B is also greater than one circumference of the transfer roller 11 and is equal to integral times of the time period required for one revolution of the transfer roller 11. The reason is that the entire circumference of the transfer roller 11 can be cleaned uniformly.

Incidentally, it is desirable that the cleaning bias is applied to the transfer roller 11 alternately, starting from the negative bias (then positive bias). The reason is that, when the negative bias is applied to clean the negatively charged toner, although almost all toner is returned to the photosensitive drum 1, since a small part of toner remains on the transfer roller 11 and the residual toner is charged positively due to discharge of the transfer roller 11 and the photosensitive drum 1, the positive bias is required to be then applied to remove the residual toner. If the positive bias is firstly applied, initial great cleaning effect cannot be achieved. Namely, if the cleaning bias is applied to the transfer roller alternately, starting from the positive bias, a longer cleaning time is required in comparison with the case starting from the negative bias, which affects a bad influence upon the service life of the photosensitive drum 1.

Here, an example that a combination of the zone A and the zone B is performed by two times is shown. The combination of the zone A and the zone B given less effect at the first time, and the greater the number of combinations performed, the greater the effect can be achieved.

After the combination of the zone A and the zone B is performed by two times, in a zone C, the primary DC charging bias is converged to 0 Volt, and the surface potential of the photosensitive drum 1 is converged to 0 Volt by turning-ON the primary charging AC bias. The reason is to remove the memory of the photosensitive drum due to execution of the great number of prints and application of a positive bias for cleaning.

Incidentally, in the illustrated embodiment, the material of the elastic layer 11*b* of the transfer roller 11 of the printer engine 41 is polar rubber such as NBR. Unlike to non-polar rubber such as EPDM, since the polar rubber has a property capable adhering toner easily, the cleaning using the negative bias and positive bias is inevitable. If the elastic layer 11*b* is made of non-polar rubber such as EPDM, since an amount of the toner adhered is small and the toner is apt to be separated, only the negative bias may be applied.

Next, the effect obtained by providing the cleaning process using the primary charging AC bias only when the number of prints is greater than a predetermined value will be explained.

Figure 4:
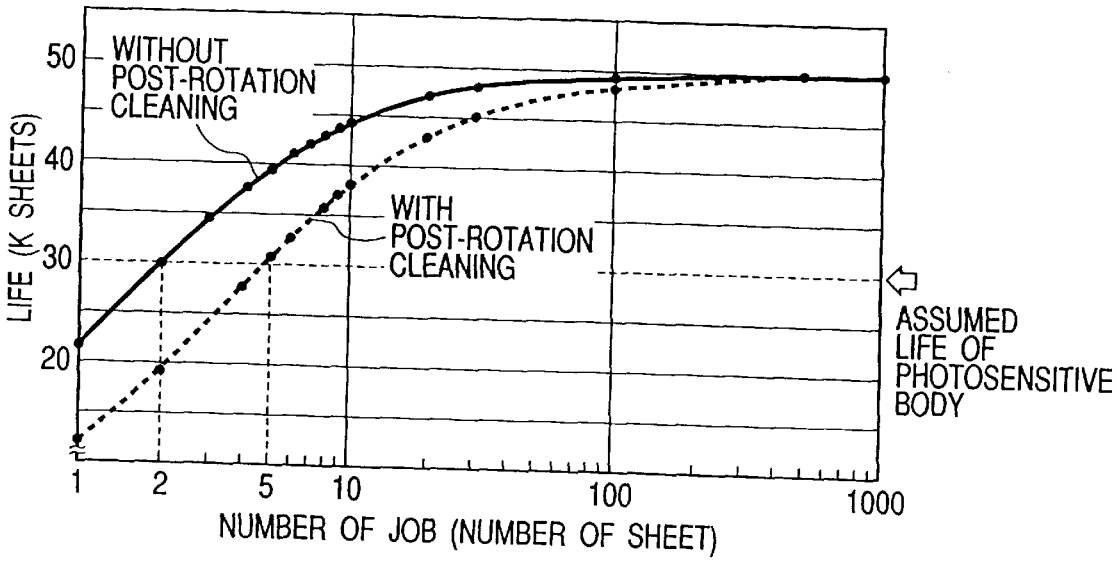
FIG. 4 is a view showing a relationship between the number of jobs and a service life of a photosensitive drum.

FIG. 4 is a graph showing a relationship between the number of prints in one job (referred to as "number of jobs" hereinafter) and the service life of the photosensitive drum 1. Here, "one job" means prints or copies effected in response to an operator's one print or copy command. "K sheets" in the ordinate is 1000 sheets. Further, in the graph, a solid line curve indicates the result when the cleaning was not effected in the post-rotation, and the broken line curve indicates the result when the cleaning was effected in the post-rotation. In both cases, the reason why the greater the number of jobs in one print the longer the service life is that a ratio of the time period for applying the cleaning bias in the post-rotation cleaning to the total time period for applying the primary charging AC bias becomes small. Normally, in a printer having a print speed greater than 20 sheets per minute, the life is generally calculated on the basis of 2 job number (number of jobs) (two-sheets intermittent). The service life of the photosensitive drum 1 in the graph was based upon a case where 30000 sheets (30 K sheets) is effected by the two-sheets intermittent. As shown in FIG. 4, when the cleaning was effected in the post-rotation, in the two-sheets intermittent, the service life of the photosensitive drum 1 is merely 20000 sheets (20 K sheets). In order to obtain the service life of 30000 sheets, the number of jobs must be 5 or more.

Thus, when the number of prints in one print is small, by not effecting the post-rotation cleaning and by effecting the cleaning only after the predetermined number of sheets, the service life of the photosensitive drum 1 was extended. In the illustrated embodiment, when the number of jobs with the post-rotation cleaning is selected to 5 or more, the life substantially the same as the life of 2 job number without the post-rotation cleaning can be achieved.

However, in the illustrated embodiment, the reason why the post-rotation cleaning is effected in the case of 20 or more job number is that the life is desired to be extended as long as possible when the number of jobs is great and that, since accumulation of smears on the transfer roller 11 had a level causing no problem regarding the image up to 100 job number, 20 job number is selected with leaving a margin.

Figure 5:
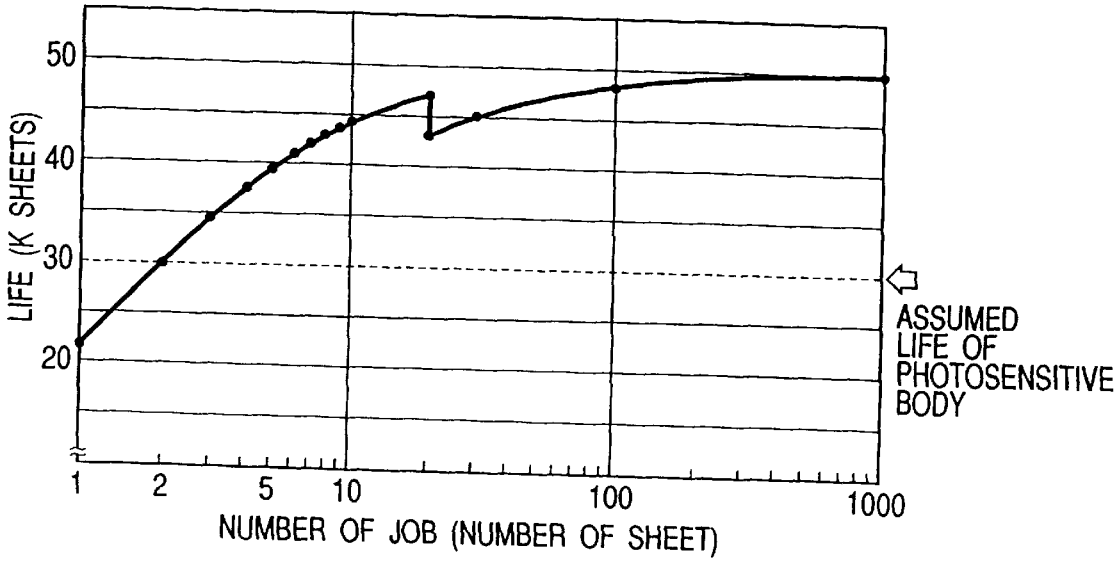
FIG. 5 is a view showing a relationship between the number of jobs and a service life of a photosensitive drum in the first embodiment.

FIG. 5 shows a relationship between the number of jobs and the service life of the photosensitive drum 1. From FIG. 5, it will be found that the relationship between the number of jobs and the life is 30000 sheets in case of 2 job number, which is the same as the conventional case. Between 19 job number and 20 job number, although the life is decreased from 47000 sheets to 43000 sheets, since 43000 sheets are greater than 30000 sheets (designed life), there is no practical problem.

When the number of jobs is small, the accumulation of smears on the transfer roller 11 is little, and thus, the transfer roller 11 can be cleaned by using the pre-rotation cleaning bias in the next print process and by transferring the accumulated toner onto back surfaces of the transfer sheets P during the print. In this case, it was found that smears on the back surface of the transfer sheet P is very little and a level of the image (smears of the back surface) does not cause any problem.

Incidentally, the cleaning process of the transfer roller 11 may be effected not only in the post-rotation but also in the pre-rotation or after all of the printing operations are finished and after rotation of a motor is stopped.

<Second embodiment>

In the above-mentioned first embodiment, while an example that the service life of the photosensitive drum 1 has a margin was explained, in a second embodiment of the present invention, a case where the cleaning ability is given preference will be explained. Incidentally, since the entire construction of an image forming apparatus is the same as that shown in FIG. 1, explanation thereof will be omitted.

Figure 6:
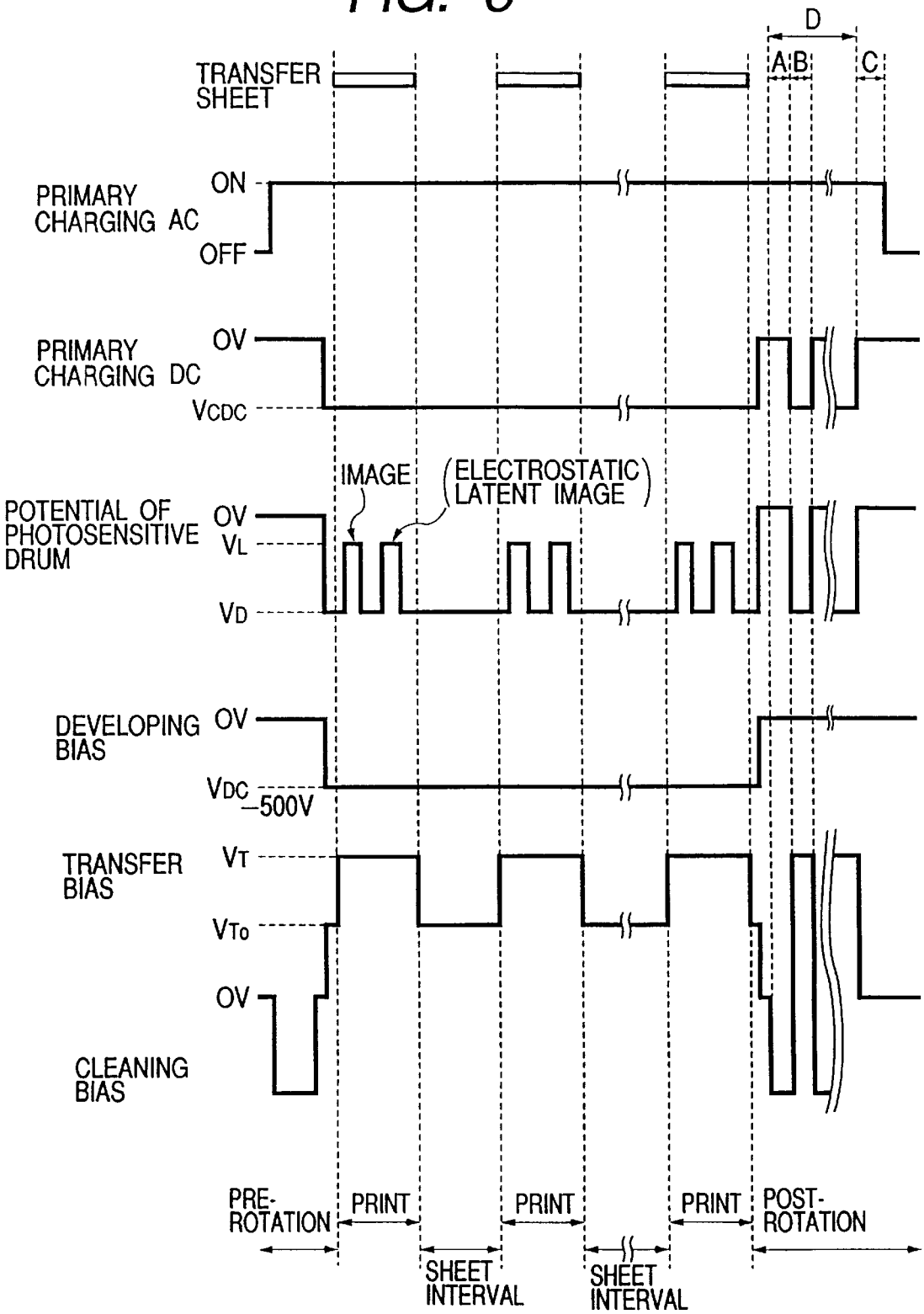
FIG. 6 is a sequence chart for cleaning a transfer roller in a second embodiment of the present invention.

FIG. 6 shows a sequence chart according to the second embodiment. In this embodiment, the post-rotation cleaning time period is changed in accordance with the number of jobs so that the cleaning time period is lengthened when the number of jobs in one print is great.

More specifically, the combination of the zones A and B for the post-rotation cleaning bias is effected by two times when the print number is from 5 to 7 both inclusive, by three times when the print number is from 8 to 12 both inclusive and by four times when the print number is from 13 to 18 both inclusive, and so on (i.e., increased in accordance with the number of jobs). Namely, the time period D for effecting the post-rotation cleaning is lengthened as the number of jobs is increased. In this way, if the contamination toner is apt to be accumulated due to the large number of jobs, the cleaning ability is improved.

Figure 7:
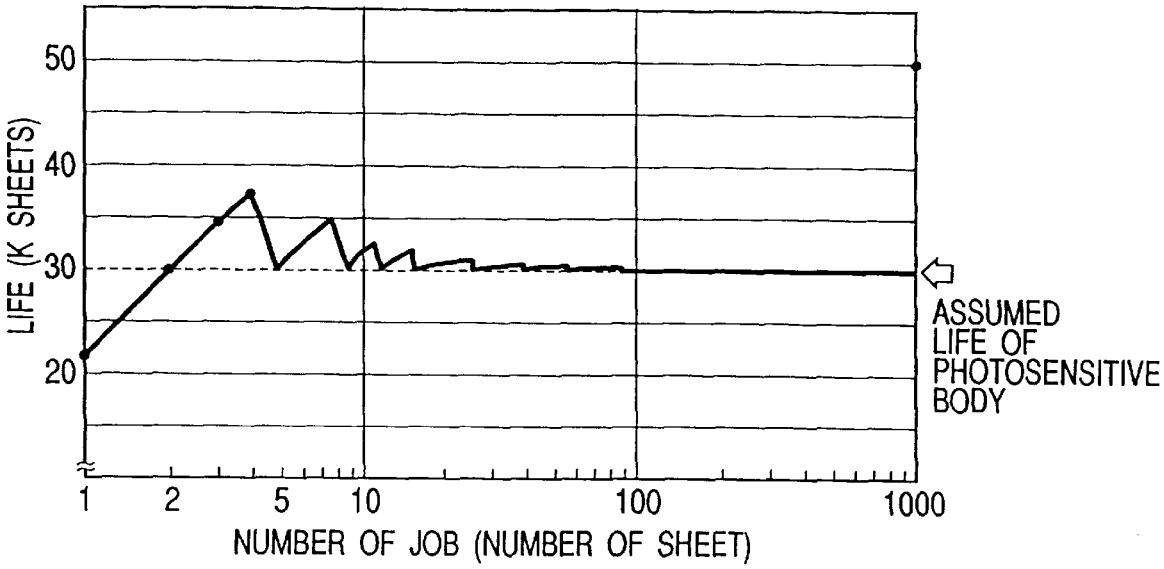
FIG. 7 is a sequence chart for cleaning a transfer roller in the second embodiment.

The service life of the photosensitive drum 1 in this case is shown in FIG. 7. Since the cleaning time period is lengthened when the number of jobs is great, the service life of the photosensitive drum 1 is not lengthened by increasing the number of jobs. However, since the service life is not decreased below the designed life, there is no practical problem.

According to the second embodiment, in a system in which fog or reversal fog is apt to occur due to developer or limitation of potential setting, an image having no smears on the back surface of the transfer sheet can be formed. Accordingly, degrees of freedom for apparatus design or material selection can be increased.

Incidentally, the cleaning process of the transfer roller 11 may be effected not only in the post-rotation but also in the pre-rotation or after all of the printing operations are finished and after rotation of a motor is stopped.

<Third embodiment>

Figure 8:
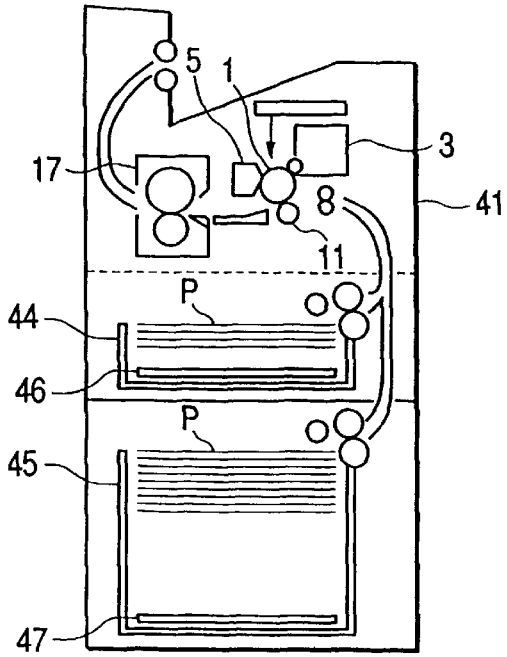
FIG. 8 is a view showing a schematic construction of an image forming apparatus according to the third embodiment.

FIG. 8 shows a schematic construction of an image forming apparatus according to a third embodiment of the present invention. Incidentally, the same elements as those in the first embodiment shown in FIG. 1 are designated by the same reference numerals, and explanation thereof will be omitted. Characteristics of the third embodiment are mainly described.

Figure 9:
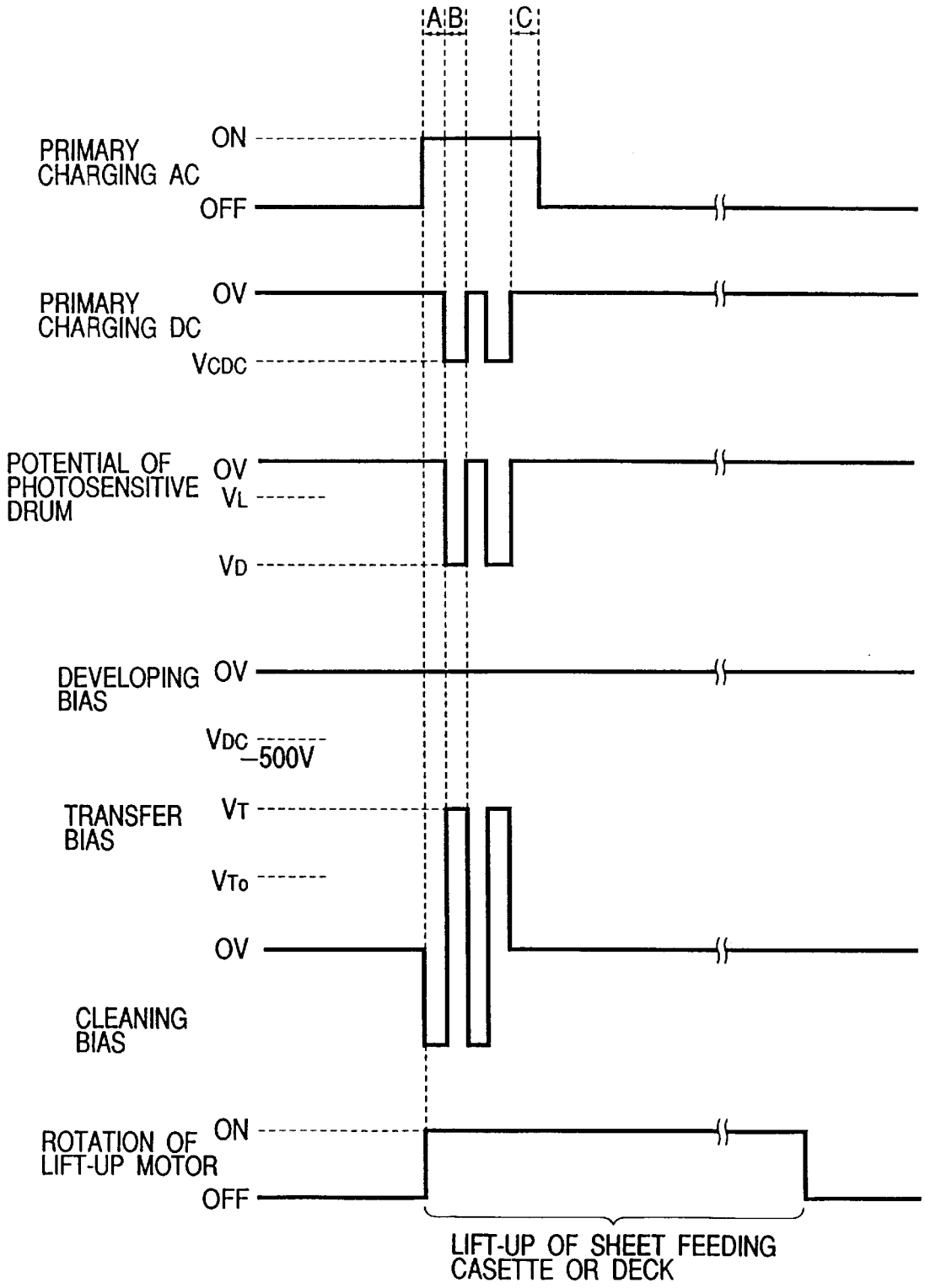
FIG. 9 is a sequence chart for cleaning a transfer roller in the third embodiment.

The image forming apparatus shown in FIG. 8 comprises a printer engine 41, a sheet feeding cassette (transfer material containing means) 44 capable of containing 500 sheets, and a deck (transfer material containing means) 45 capable of containing 2000 sheets. A cassette intermediate plate 46 disposed within the sheet feeding cassette 44 and adapted to lift transfer sheets P and a similar deck intermediate plate 47 disposed within the deck 45 are driven by a main motor (not shown) of the printer engine 41 in replenishment of sheets. Thus, during lifting-up of the cassette intermediate plate 46 and the deck intermediate plate 47, the photosensitive drum 1 is rotated. Such an arrangement is general in middle-size and small-size image forming apparatuses. In the illustrated embodiment, during lifting-up of the cassette intermediate plate 46 or the deck intermediate plate 47, till the sheet can be fed from the cassette or the deck, the cleaning of the transfer roller 11 is effected. FIG. 9 is a sequence chart showing such cleaning.

The cleaning sequence for the transfer roller 11 is performed together with rotation for the lift-up. Although explanation of the process will be omitted since the process is the same as the post-rotation sequence in the first embodiment, after the combination of the zones A and B for cleaning the transfer roller 11 is effected by two times and the zone C for stabilizing the potential of the photosensitive drum 1 is effected by one time, all of the biases are turned OFF, and the main motor is rotated until the lift-up is finished. As a result, the cleaning of the transfer roller 11 can be effected even during the lift-up.

According to the third embodiment, the cleaning sequence is effected only in the replenishment of transfer sheets P regarding the sheet feeding cassette 44 or the deck 45, i.e., effected every 500 sheets or 2000 sheets. Thus, since the number of jobs becomes 500 or 2000, as can be seen from the relationship between the number of jobs and the life shown in FIG. 4, the service life of the photosensitive drum 1 is almost not influenced.

While the invention was explained in connection with embodiments thereof, the present invention is not limited to such embodiments, but, alterations can be made within the scope of the invention.

What is claimed is:

1. An image forming apparatus comprising:

an image bearing body for bearing a toner image;

a transfer member for electrostatically transferring the toner image on said image bearing body, wherein said apparatus effects image formations on a plurality of sheets in one job cleaning bias applying means for electrostatically cleaning said transfer member by applying a cleaning bias to said transfer member, wherein said cleaning bias applying means applies the cleaning bias to said transfer member after the job is finished; and control means for controlling application of the cleaning bias after the job is finished in accordance with number of sheets to be image-formed in one image forming job.

2. An image forming apparatus according to claim 1, wherein said control means controls the application of the cleaning bias in such a manner that the cleaning is effected when the number of sheets to be image-formed is greater than or equal to a predetermined value and the cleaning is not effected when the number of sheets to be image-formed is smaller than the predetermined value.

3. An image forming apparatus according to claim 1, wherein said control means controls a time period for applying the cleaning bias.

4. An image forming apparatus according to claim 3, wherein said control means controls in such a manner that the time period for applying the cleaning bias is increased when the number of sheets to be image-formed is greater than or equal to a predetermined value.

5. An image forming apparatus according to claim 1, wherein said cleaning bias applying means applies the cleaning bias to said transfer member before the job is started.

6. An image forming apparatus according to claim 5, wherein a cleaning bias applying condition before the job is started is constant regardless of the number of sheets to be image-formed.

7. An image forming apparatus according to claim 1, wherein said cleaning bias applying means applies a cleaning bias having the same polarity as that of a toner and a cleaning bias having a polarity opposite to that of the toner to said transfer member.

8. An image forming apparatus according to claim 1, wherein said transfer member has a roller shape and cooperates with said image bearing body to form a nip therebetween.

9. An image forming apparatus according to claim 1, further comprising a charging member for uniformly charging said image bearing body and an alternate current power source for applying an alternate current voltage to said charging member, wherein a surface portion of said image bearing body located at a transfer position during the application of the cleaning bias is subjected to alternate current electricity removal by said charging member.

10. An image forming apparatus according to claim 9, further comprising a direct current power source for applying a direct current voltage to said charging member, wherein the direct current voltage and the alternate current voltage are applied to said charging member in an overlapped fashion during image formation.

* * * * *

UNITED STATES PATENT AND TRADEMARK OFFICE

CERTIFICATE OF CORRECTION

PATENT NO. : 6,173,135 B1
DATED : January 9, 2001
INVENTOR(S) : Takayasu Yuminamochi, et al.

It is certified that error appears in the above-identified patent and that said Letters Patent is hereby corrected as shown below:

Column 1,
Line 42, "in synchronous" should read -- synchronously --;
Line 45, "in synchronous" should read -- synchronously --;
Line 54, "in" should read -- syncchronously --;
Line 55, "sychronous" should be deleted; and
Line 57, "in synchronous" should read -- synchronously --.

Column 3,
Line 7, "image-form ed" should read -- image-formed --.

Column 5,
Line 67, "in sychronous" should read -- synchronously --.

Column 6,
Line 7, "In synchronism" should read -- Synchronously --;
Line 47, "affects" should read -- effects --;
Line 65, "to" should be deleted; and
Line 67, "capable adhering toner" should read -- of causing toner to adhere --.

Column 10,
Line 32, "alternate" should read -- alternating --;
Line 33, "alternate" should read -- alternating --;
Line 36, "alternate" should read -- alternating --; and
Line 41, "alternate" should read -- alternating --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*